US005720141A

United States Patent [19]

Goff

[11] Patent Number: 5,720,141

[45] Date of Patent: Feb. 24, 1998

[54] STRUCTURE AND METHOD FOR ENCAPSULATING AN EXISTING BUILDING

[75] Inventor: Todd A. Goff, Topeka, Kans.

[73] Assignee: PTMW, Incorporated, Topeka, Kans.

[21] Appl. No.: 519,636

[22] Filed: Aug. 25, 1995

Related U.S. Application Data

[62] Division of Ser. No. 102,847, Aug. 6, 1993, Pat. No. 5,499,482.

[51] Int. Cl.[6] ..... E04B 1/74; E02D 27/48

[52] U.S. Cl. ..... 52/265; 52/269; 52/293.3; 52/299; 405/230

[58] Field of Search ..... 52/265, 269, 299, 52/293.3, 79.1, 79.12, 3, 4, 127.2; 405/229, 230

[56] References Cited

U.S. PATENT DOCUMENTS

| | | | |
|---|---|---|---|
| 631,541 | 8/1899 | Hewitt | 52/79.1 |
| 960,207 | 5/1910 | Slater . | |
| 3,771,273 | 11/1973 | Brodie . | |
| 4,470,227 | 9/1984 | Bigelow, Jr. et al. | 52/79.1 |
| 4,573,292 | 3/1986 | Kaufman et al. | 52/79.1 |

*Primary Examiner*—Michael Safavi
*Attorney, Agent, or Firm*—Shook, Hardy & Bacon

[57] ABSTRACT

A structure for encapsulating an existing building includes an underpinning system for mounting on the existing building. The underpinning system includes a perimeter frame assembly with side and end rafts, outrigger assemblies mounted on the side rails and scissor jack assemblies recounted on the end rails. A shell system is mounted on the perimeter frame assembly and includes side walls, end walls and a roof. Door assemblies are installed in the end walls. A method of encapsulating an existing building includes the steps of providing an underpinning system, fastening the underpinning system to the existing building, providing a shell system with side walls, end walls, a roof and an open bottom, and receiving the existing building through the shed system open bottom for placing the shell system in covering relation over the existing building. The encapsulating method further includes the steps of fastening the shell system to the underpinning system and injecting insulating foam into an interstitial space formed between the shell system and the existing building.

37 Claims, 5 Drawing Sheets

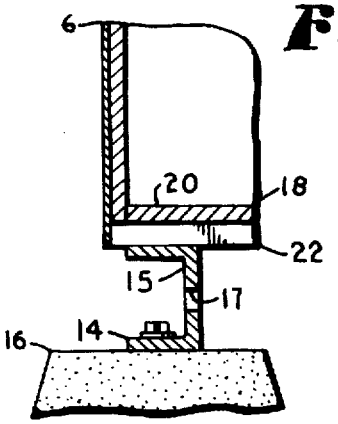
Fig.5.
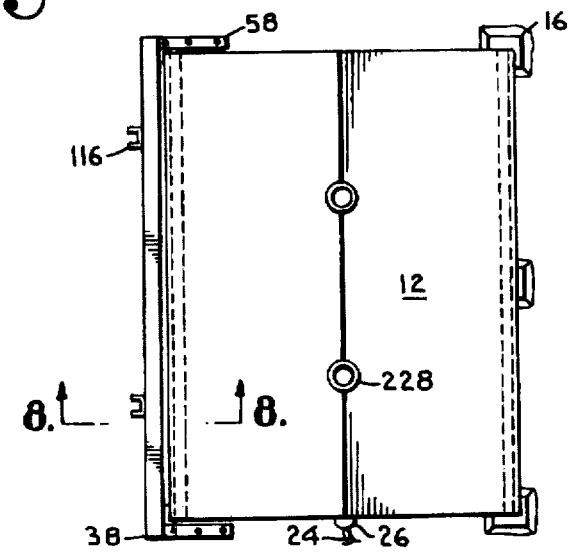
Fig.7.
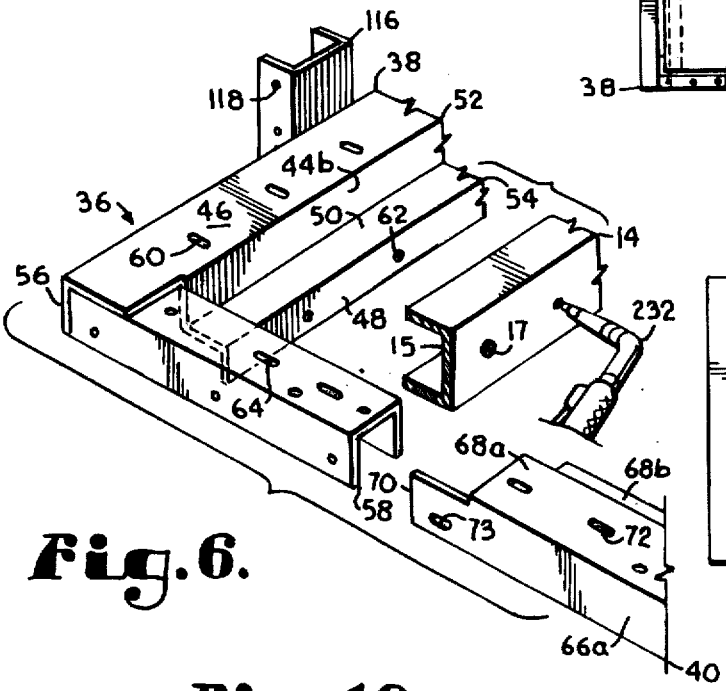
Fig.6.
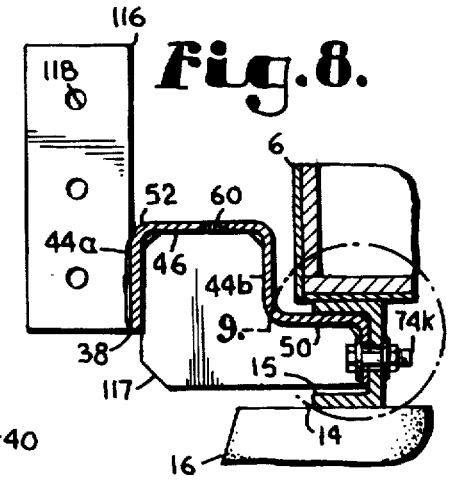
Fig.8.
Fig.10.
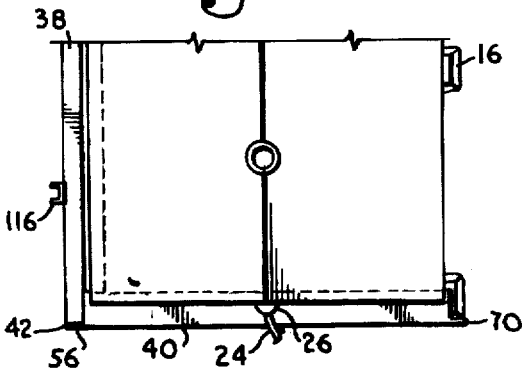
Fig.9.
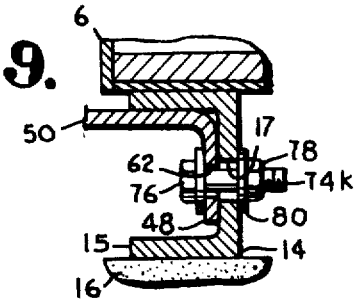

Fig.10a.
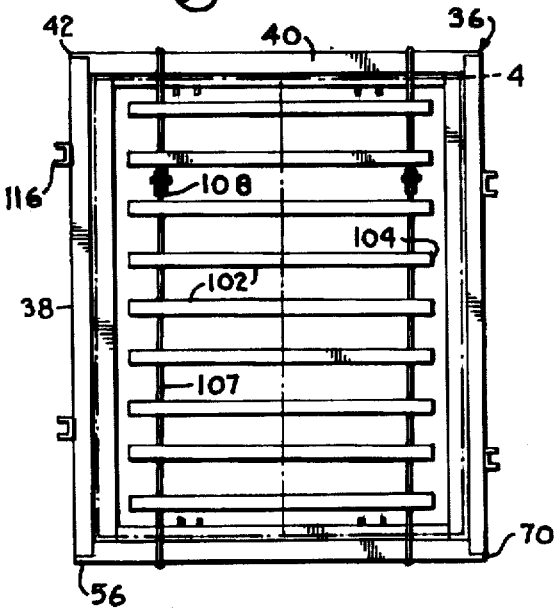
Fig.12.
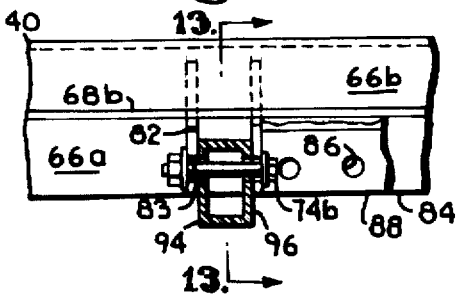
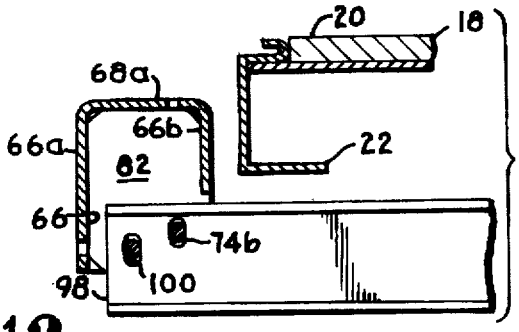
Fig.13.
Fig.11.
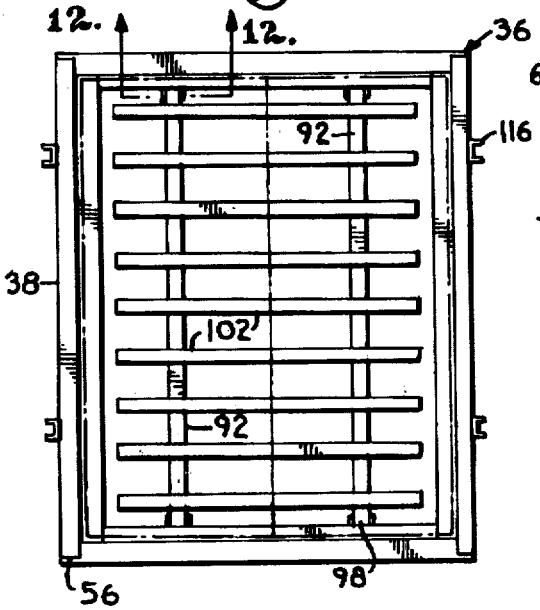
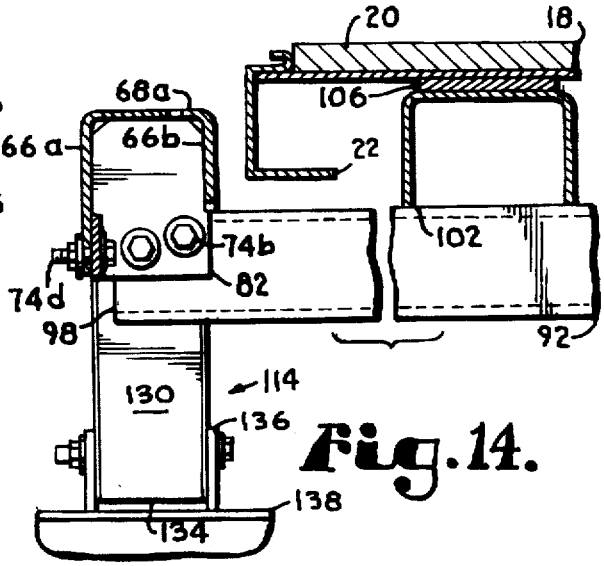
Fig.14.

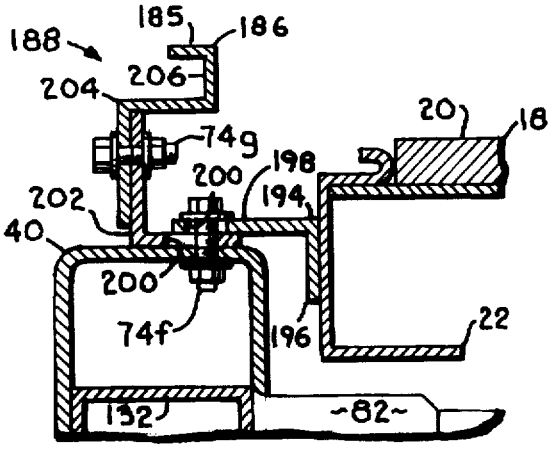
Fig. 16.
Fig. 15.
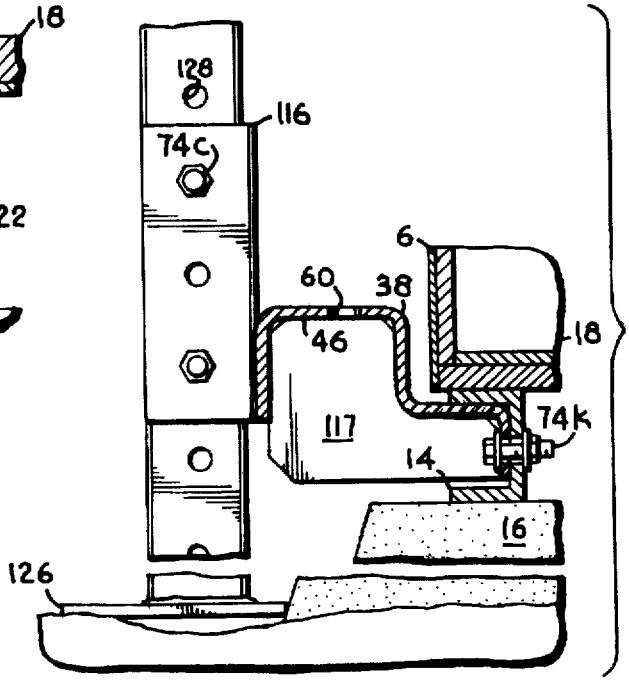
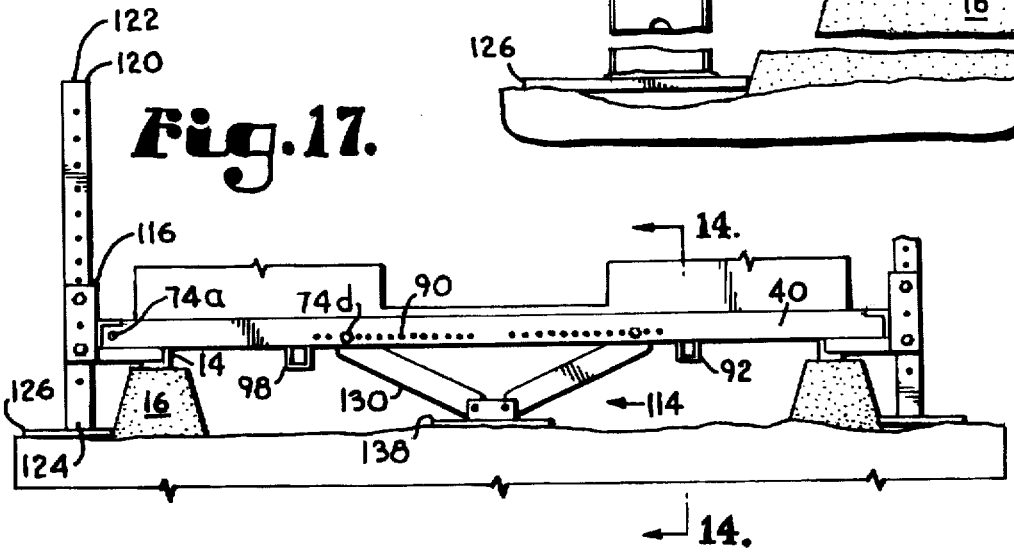
Fig. 17.
Fig. 19.
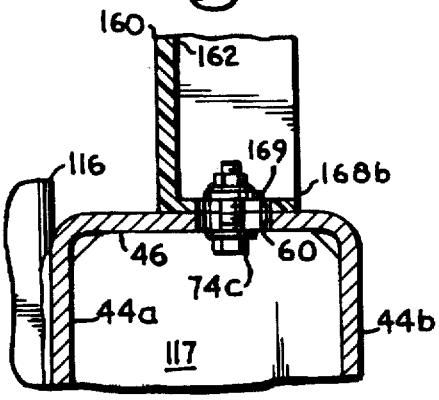
Fig. 20.
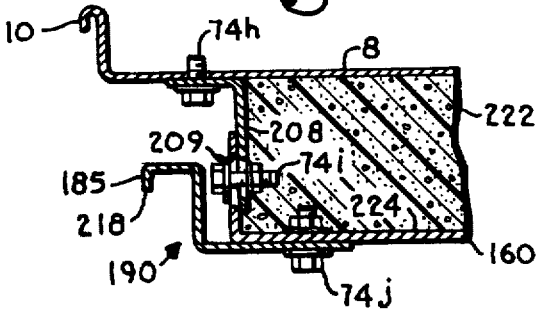

STRUCTURE AND METHOD FOR ENCAPSULATING AN EXISTING BUILDING

This application is a divisional of U.S. application Ser. No. 08/102,847, filed Aug. 6, 1993, now U.S. Pat. No. 5,499,482.

BACKGROUND OF THE INVENTION

1. Field of the Invention

This invention relates generally to buildings, and in particular to a structure and method for encapsulating an existing building by installing an underpinning system thereunder and placing a shell system thereover.

2. Description of the Related Art

Various types of buildings have heretofore been proposed for creating enclosed, sheltered spaces for a wide variety of purposes. For example, habitable structures are designed to shelter their occupants and accommodate their indoor activities, such as working, eating, sleeping, etc.

Uninhabited structures are commonly used to house equipment and can be designed to protect equipment enclosed therein from certain ambient conditions, such as precipitation, solar insolation, etc. The temperature within such uninhabited structures can either be controlled or permitted to vary according to the ambient temperature; depending upon the requirements of the equipment sheltered therein. For example, certain types of equipment operate satisfactorily in a wide range of ambient temperatures and can thus be enclosed in buildings which are not heated or cooled. Structures which enclose equipment also provide security and protection therefor, and can provide safety by shielding unauthorized persons from dangerous equipment and machinery.

Various exterior building materials have previously been employed for withstanding and repelling ambient environmental conditions. However, many types of external building materials tend to weather and deteriorate due to the effects of prolonged exposure to the elements. Buildings constructed of such materials can require periodic maintenance, such as painting and replacement of deteriorating materials, which tends to increase the life-cycle building costs. There have been many attempts to develop buildings which require little or no maintenance and which are constructed of highly weather resistant materials.

A relatively common example of an uninhabited building type for housing equipment can be found along many railroad rights-of-way. Switchgear and other electrical and electronic equipment such as transformers, relays, etc. are typically located in such buildings at spaced locations alongside many railroad tracks. Such buildings can be relatively small, for example, approximately six feet wide, approximately eight feet long and approximately eight to ten feet high. Many such buildings are located in relatively remote areas. Due to their remoteness, service calls for inspection and maintenance tend to be relatively expensive and inconvenient. Therefore, railroads and other companies with inventories of equipment buildings in remote locations commonly construct such buildings, to the extent practicable, of relatively low-maintenance materials.

Sheet metal has been a relatively popular choice for the shells of these buildings because it tends to be relatively strong and because sheet metal buildings of this type can be assembled relatively quickly in situ. Moreover, since many of these buildings are not heated or cooled, the relatively high thermal conductivity of steel is generally not considered a particular disadvantage. However, a advantage with steel is its susceptibility to rust and corrosion, particularly if left exposed to the elements. Although paint, galvanizing and other coatings can retard such deterioration, relatively harsh environments and relatively infrequent maintenance have resulted in rust and corrosion damage to a number of buildings of this type.

The encapsulating structure and method of the present invention address the aforementioned problems of deterioration and shell damage in existing buildings, particularly such deterioration and damage which are caused or enhanced by exposure to the elements.

SUMMARY OF THE INVENTION

In the practice of the present invention, a structure is provided for encapsulating an existing building and generally comprises an underpinning system and a shell system. The underpinning system includes a perimeter frame assembly comprising side and end rails. The side rails are fastened to the existing building. A foundation subsystem includes outrigger assemblies mounted on the side rails and scissor jack assemblies mounted on the end rails. Floor joists are supported on floor support beams below the floor structure of the existing building for supporting same. The shell system includes side and end walls comprising wall panels mounted on the perimeter frame assembly. Door assemblies are mounted in the end walls and a roof is mounted on top of the walls. An interstitial space between the existing building and the shell system is filled with insulating material, such as polyurethane foam which can be injected through foam inlet ports in the wall panels and in the roof.

In the practice of the method of the present invention, a perimeter frame is mounted on floor support members of an existing building and is adjusted for the size of the existing building. The perimeter frame assembly is supported above a ground surface by a foundation system which is vertically adjusted to extend between the perimeter frame assembly and the ground surface below the extending building. A shell system comprising side walls, end walls and a roof can be preassembled for installation in situ by lowering it over the existing building onto the perimeter frame assembly. An interstitial space is formed between the shell system and the existing building. The method further includes the step of injecting insulating material, such as foam, into the interstitial space. The end walls are provided with door openings which receive door assemblies for adjustable engagement with the existing building to enclose the interstitial space adjacent to the door openings. On the job site, lifting lines are attached to the shell system roof and the shell system is lifted over the existing building by suitable lifting equipment and is lowered in place thereover.

OBJECTS AND ADVANTAGES OF THE INVENTION

The principal objects and advantages of the present invention include: providing a structure for encapsulating an existing building; providing such a structure with an underpinning system adapted for mounting on the existing building; providing such a structure with a shell system adapted for prefabrication remote from the job site and installation in situ; providing such a structure which is size adjustable for accommodating existing buildings of different sizes and configurations; providing such a structure with a foundation subsystem adapted for adjustably extending between a perimeter frame assembly and a ground surface under the existing building; providing such a structure with an underpinning system adapted for supporting an existing floor structure; providing such a structure which provides an interstitial space around the existing building; providing such a structure with insulating material in the interstitial space; providing such a structure which can relatively effectively shield the contents of the existing building from the elements; providing such a structure which can be constructed of relatively common building materials; and providing such a structure which is economical to manufacture, efficient in operation, capable of a long operating life and which requires relatively little maintenance; providing a method of encapsulating an existing building; providing such a method wherein an adjustable underpinning system is adjustably mounted on the existing building; providing such a method which can accommodate various sizes and configurations of existing buildings; providing such a method which effectively and economically encapsulates existing buildings, thus protecting against further environmental damage thereto and deterioration thereof; providing such a method which includes the steps of prefabricating a shell assembly at a location remote from the job site and installing the prefabricated shell system in situ; providing such a method which is relatively economical; providing such a method which requires relatively little time for encapsulating an existing building; providing such a method which includes the step of insulating an interstitial space between the existing building and the prefabricated shell system; and providing such a method which is particularly well-adapted for encapsulating existing buildings which are remotely located; and providing such a method which is particularly well-adapted for encapsulating relatively large numbers of existing building which tend to have relatively standard sizes, configurations and components.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a vertical cross-sectional view of the existing building taken generally along line 5—5 in FIG. 1 and particularly showing an existing channel-section floor support member.

FIG. 6 is a fragmentary, exploded upper perspective view showing a corner of a perimeter frame assembly of the encapsulating structure and also showing receivers being torch-cut in an existing channel-section floor support member.

FIG. 7 is a top plan view of the existing building shown with a side rail of the perimeter frame assembly mounted thereon.

FIG. 8 is a vertical cross-sectional view taken generally along line 8—8 in FIG. 7 and particularly showing the mounting of a side rail on an existing channel-section floor support member.

FIG. 9 is an enlarged detail of the area generally shown in circle 9 in FIG. 8.

FIG. 10 is a fragmentary top plan view of the existing building, shown with side and end rails of the perimeter frame assembly mounted thereon.

FIG. **10*a*** is a top plan view of the underpinning system of the encapsulating structure, shown with installation cables in place for installing floor joists thereof.

FIG. 11 is a top plan view of the underpinning system, shown with floor support beams thereof installed.

FIG. 12 is a vertical cross-sectional view taken generally along line 12—12 in FIG. 11.

FIG. 13 is a vertical cross-sectional view taken generally along line 13—13 in FIG. 12.

FIG. 14 is a vertical cross-sectional view taken generally along line 14—14 in FIG. 17.

FIG. 15 is a vertical cross-sectional view of the area generally shown in circle 15 in FIG. 17.

Figure 4:
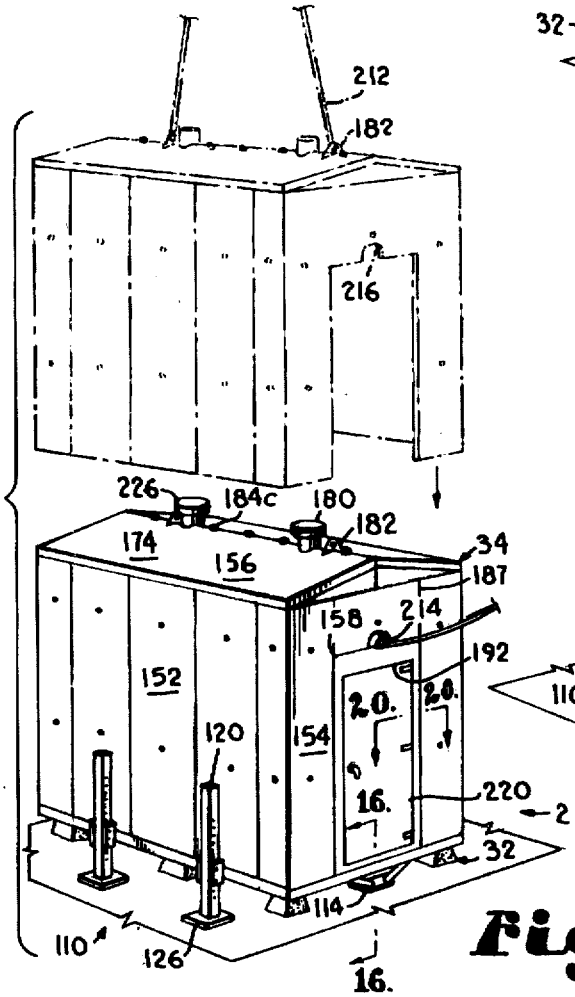
FIG. 4 is an upper perspective view of the encapsulating structure.

FIG. 16 is a vertical cross-sectional view taken generally along line 16—16 in FIG. 4 and particularly showing a seal subassembly of a door assembly.

FIG. 17 is a fragmentary, front elevational view of the underpinning system.

Figure 18:
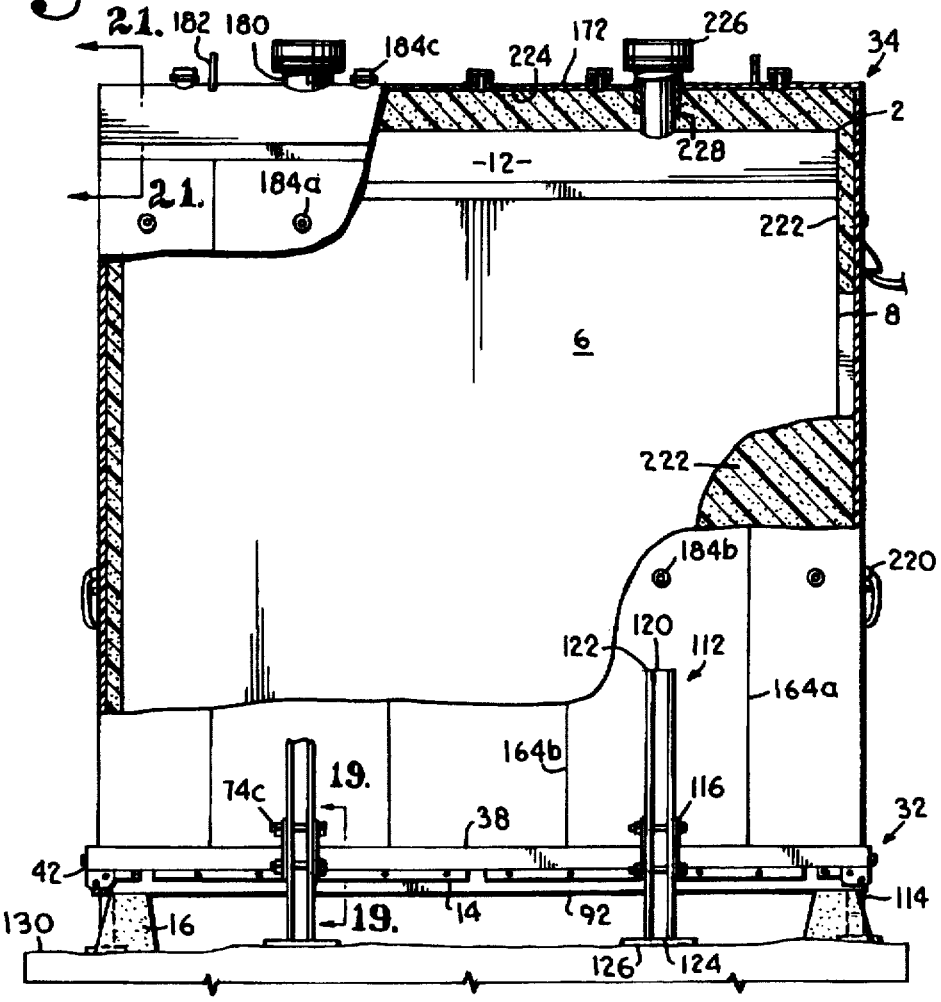

FIG. 18 is a side elevational view of the encapsulating structure with portions broken away to reveal internal construction.

FIG. 19 is a vertical cross-sectional view taken generally along line 19 in FIG. 18.

FIG. 20 is a horizontal cross-sectional view taken generally along line 20—20 in FIG. 4 and particularly showing a jamb subassembly of the door assembly.

Figure 21:
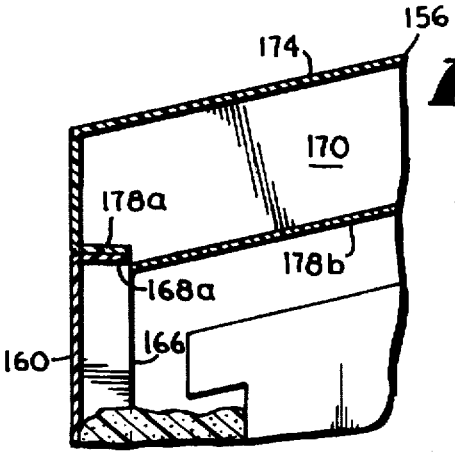

FIG. 21 is a vertical cross-sectional view taken generally along line 21—21 in FIG. 18.

Figure 22:
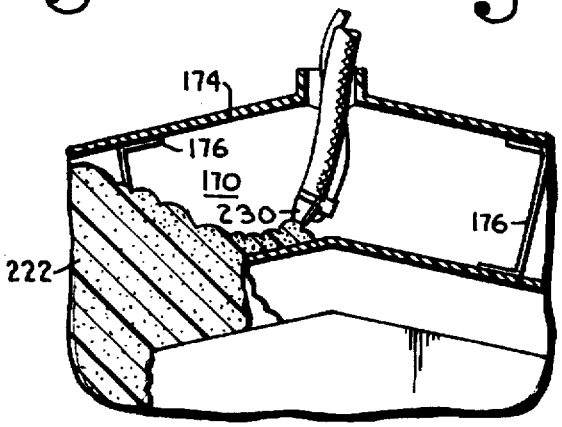

FIG. 22 is a vertical cross-sectional view, particularly showing the injection of foam in an interstitial space between the existing roof and the encapsulating structure roof.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a structure for encapsulating or enclosing an existing building 4. Without limitation on the generality of existing buildings which can be encapsulated or enclosed by the structure 2, a building 4 is shown which is of a type commonly located along railroad rights-of-way for enclosing electrical equipment such as switchgear, communications equipment, power distribution equipment and the like.

The existing building 4 includes opposite side wall 6, opposite end walls 8 4 and a roof 12 (FIG. 4). One or both of the end walls 8 can include a door opening 10 mounting a door 11. The existing doors 11 can be removed from the existing door openings 10 prior to encapsulation.

The existing building 4 is supported on a pair of existing floor support or channel members 14 each resting on and supported by a plurality (e.g., three on each side are shown) of concrete foundation piers 16. An existing floor structure rests on and is supported by the channel members 14, each of which includes an outwardly-open channel 15. The existing floor structure 18 includes an existing floor deck 20 and a plurality of transversely-extending floor flanges 22 (FIG. 5).

Figure 1:
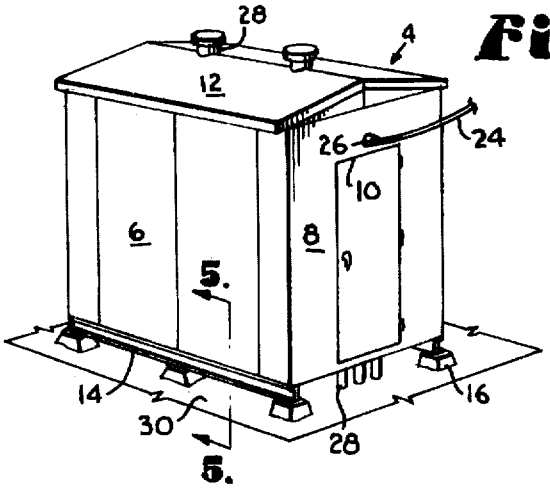
FIG. 1 is an upper perspective view of an existing building of the type which can be encapsulated by the structure and method of the present invention.
Figure 2:
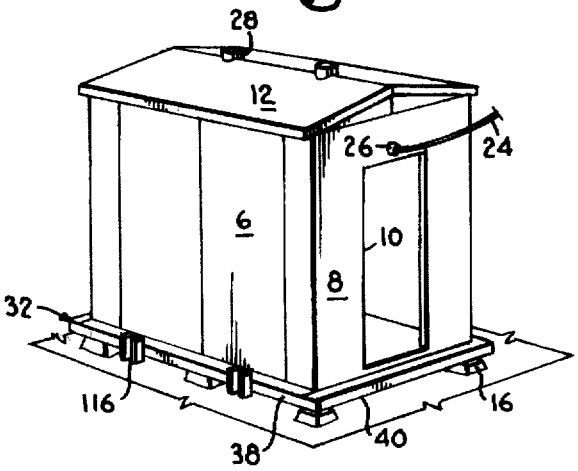
FIG. 2 is an upper perspective view of the existing building, shown with portions of an underpinning system of the encapsulating structure installed.

Electrical service lines 24 enter the existing building 4 by way of a masthead 26. Buried service lines enter the existing building 4 through riser conduits 28 (FIG. 1).

The structure 2 generally comprises an underpinning system or means 32 and a shell system or means 34.

II. Underpinning System or Means 32

The underpinning system or means 32 includes a perimeter frame assembly which includes a pair of frame side rails 38 and a pair of frame end rails 40 interconnected at respective corners 42 whereby the frame assembly 36 has a generally rectangular configuration (FIG. 10*a*).

Each frame side rail 38 has outer and inner, generally vertical main flanges 44*a*, 44*b* which are interconnected along their upper edges by a generally horizontal main web 46. Each frame side rail 38 also includes an inner, generally vertical mounting member flange 48 connected to a lower edge of the inner main flange 44*b* by a mounting member web 50. The main flanges 44*a*, 44*b* and the main web 46 collectively form a frame side rail channel member 52. The inner, mounting member flange 48 and the mounting member web 50 collectively form an angle-section mounting member 54 (FIG. 8).

Each frame side rail 38 includes opposite ends 56 each mounting at a right angle a respective coupler 58 with the general configuration of a downwardly-open channel. At each side rail end 56, the inner main flange 44*b*, the mounting member flange 48 and the mounting member web 50 are recessed to receive a respective coupler 58 (FIG. 6).

Each side rail main web 46 includes a plurality of longitudinally-spaced, elongated, transversely-oriented, slotted receivers 60. Each mounting member flange 48 includes a plurality of longitudinally-spaced receivers 62. Each coupler 58 includes a plurality of longitudinally-spaced receivers 64, which can be slotted, in upper and outer legs thereof (FIG. 6).

Each end rail 40 includes outer and inner end rail flanges 66*a*, 66*b* and upper and lower end rail webs 68*a*, 68*b*. The end raft upper web 68*a* connects the end rail flanges 66*a*, 66*b* along their upper edges and the end raft lower web 68*b* projects generally horizontally inwardly from a lower edge of the end rail inner flange 66*b* (FIG. 13).

Each end rail 40 includes opposite ends 70 whereat the end rail inner flange 66*b* and the end rail webs 68*a*, 68*b* are recessed to receive a respective side rail end 56, with a respective coupler 58 being positioned between the end rail flanges 66*a*, 66*b* and below the end rail upper web 68*a*. Each end rail upper web 68*a* includes a plurality of receivers 72, which can be slotted (FIG. 6). Each end raft outer flange 66*a* also includes a plurality of elongated, longitudinally-oriented, slotted receivers 73 adapted for adjustable alignment with respective coupler receivers 64. The end rail upper web receivers 72 in proximity to the end rail ends 70 are also adapted for adjustable alignment with respective coupler receivers 64. Each end rail end 70 receives a respective coupler 58 and is adjustably secured thereto by mechanical fasteners 74*a* extending through aligned coupler receivers 64 and end rail receivers 72, 73 (FIGS. 6 and 17). The mechanical fasteners 74*a* can comprise bolts 76, nuts 78 and washers 80 (FIG. 9). Alternatively, other types of mechanical fasteners could be employed, such as rivets, or the couplers 58 could be welded to the side rail ends 70 for a more permanent connection.

Each end rail 40 includes two pairs of floor support beam brackets 82 fastened (e.g., by welding) to its underside. The beam brackets 82 have generally L-shaped configurations for fixed engagement with the end rail flanges 66*a*, 66*b* and the end rail webs 68*a*, 68*b*. The beam bracket pairs are mounted on each end rail 40 in spaced relation inwardly from respective ends 70 thereof (FIGS. 12 6 and 13). Each end rail 40 includes an angle-section stiffener 84 fastened (e.g., by welding) to and extending between respective inner beam brackets 82. Each stiffener 84 includes a plurality of transversely-spaced receivers 86 in a vertical leg 88 thereof, which align with corresponding receivers 90 in a respective side rail outer flange 66*a* (FIGS. 12, 14 and 17).

A pair of floor support beams 92 extend longitudinally between respective opposed pairs of beam brackets 82 (FIG. 11), and each has the general configuration of a box beam and can be formed by closing off the channel of a channel section 92 with a plate 96 (FIG. 12) or with a second, smaller channel section.

Each floor support beam 92 includes opposite ends 98 with receivers 100 for receiving mechanical fasteners 74*b* which extend through the receivers 100 and through corresponding receivers 83 in the beam brackets 82. The beam bracket receivers 83 comprise vertically-oriented slots for vertically, adjustably mounting the floor support beam ends 98 (FIG. 13).

A plurality of channel-section floor joists 102 are placed on the floor support beams 92 and extend transversely with respect thereto (FIG. 11). Each floor joist 102 includes opposite ends 104 which terminate in spaced relation inwardly from respective frame side rails 38. The floor joists 102 are downwardly-open when placed on the floor support beams 92. Strips 106 comprising a resilient material, such as rubber, are placed on top of the floor joists 102 and engage the underside of the existing floor deck 20 (FIG. 14).

Figure 3:
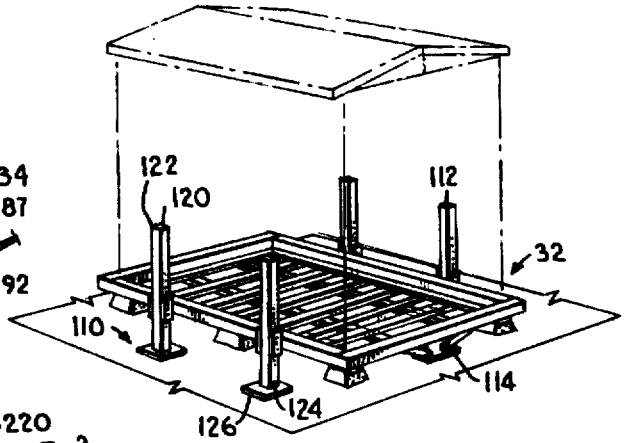
FIG. 3 is an upper perspective view, particularly showing the underpinning system of the encapsulating structure embodying the present invention.

The underpinning system or means 32 includes a foundation subsystem or means 110, which generally comprises .two pain of outrigger assemblies 112, each pair being mounted on a respective frame side rail 38, and a pair of scissor jack assemblies 114 each mounted on a respective flame end rail 40 (FIG. 3).

Each outrigger assembly 112 includes an outrigger mounting channel 116 with horizontally-opposed pairs of receivers 18. A pair of mounting channels 116 are affixed (e.g., by welding) to each side rail outer main flange 44*a* in spaced relation inwardly from a respective side rail end 56. Each outrigger assembly 112 includes a channel section outrigger leg 120 with an upper end 122 adapted for protruding above a respective mounting channel 116 and a lower end 124 mounting a base plate 126. Each outrigger leg 120 includes a plurality of opposed pairs of receivers 128 in spaced relation along both sides thereof in horizontally aligned pairs. The outrigger legs 120 are height-adjustably mounted on respective mounting channels 116 by means of mechanical fasteners 74*c*. Two pairs of gussets 117 are mounted in each side rail 38 with each pair being adjacent to a respective outrigger mounting channel 116 (FIGS. 15 and 17).

Each scissor jack assembly 114 (FIGS. 14 and 17) includes a pair of scissor jack legs 130 which are adjustably splayed with respect to each other to form an adjustable, included angle therebetween. Each scissor jack leg 130 includes upper and lower ends 132, 134. Each scissor jack assembly 114 includes a base channel 136 affixed (e.g, by welding) in an upwardly-open orientation on a respective scissor jack assembly base plate 138. Each scissor jack leg 130 is mounted at its upper and lower ends 132, 134 to the frame end rail 40 and the base channel 136 respectively by mechanical fasteners 74*d*. The upper mechanical fasteners 74*d* extend through respective, aligned receivers 86, 90 and the leg upper ends 132.

The height of each outrigger assembly 112 is adjustable by utilizing different receivers 128 and the heights of the scissor jack assemblies 114 are adjustable by utilizing different pairs of receivers 86, 90.

III. Shell System or Means 34

The shell system or means 34 generally includes opposite side walls 152, opposite end walls 154, a roof 156, an open bottom 210 and a pair of door assemblies 158. Each door assembly 158 is located in a respective end wall 154.

The walls 152, 154 generally comprise wall panels 160 with outer wall skins 162 and first and second edges 164*a*, 164*b* which are formed for interconnection of adjacent panels 160 and which provide rigidity for the wall panels 160 by forming wall studs 166. Each wall panel 160 also includes upper and lower flanges 168*a*, 168*b* which project inwardly from respective wall panel skins 162. Each wall panel lower flange 168*b* includes a plurality of slotted receivers 169 which align with respective side rail main web and end rail upper web receivers 60, 72 for receiving mechanical fasteners 74*e* whereby the wall panels 160 are mounted on the side and end rails 38, 40. The wall panel lower flanges 168*b* can be notched to clear the coupler-to-end raft mechanical fasteners 74*a* adjacent to the frame assembly corners 42. The mechanical fasteners 74*e* can comprise bolt, nut and washer combinations with the nuts welded onto the bolts for relatively permanent mounting.

The roof 156 includes roof rafters 170 which slope outwardly and downwardly from a ridge line 172, a roof skin 174 and purlins 176 which extend generally horizontally and longitudinally between respective adjacent pairs of rafters 170. The roof 156 includes side and end flanges 178*a*, 178*b* for attachment to the wall upper flanges 168*a*. The roof 156 also includes a plurality of vents 180 and a pair of lifting lugs 182, all of which project upwardly from the ridge line 172.

The wall panels 160 include upper and lower sets of foam inlet or injection ports 184*a*, 184*b* and the roof 156 includes a plurality of foam injection ports 184*c*. Pipe nipples with diameters of, for example, 3', can be used for the roof foam injection ports 184*c*.

Each end wall 154 includes a door opening 185 and a transom panel 187 located thereover. Each door assembly 158 includes a respective door frame 186 with respective sill, jamb and head subassemblies 188, 190, 192. The sill subassembly 188 (FIG. 16) includes an angle-section spacer 194 with a vertical leg 196 adapted for engaging the existing floor structure 18 and a horizontal leg with slotted receivers 200 adapted for receiving end rail-to-sill subassembly mechanical fasteners 74*f*. The sill subassembly 188 also includes an angle-section transition member 202 mounted on a respective end rail upper web 68 and in turn mounting a respective sill threshold 204 by means of a plurality of transition member-to-threshold mechanical fasteners 74*g*. The sill threshold 204 includes an outwardly open sill channel 206.

Each jamb and head subassembly 190, 192 includes an angle-section jamb/head spacer 208 mounted on an existing end wall 8 by spacer-to-end wall mechanical fasteners 74*h*. The spacers 208 project outwardly from the existing end walls 8 for adjustable connection to respective wall panels 160 (FIG. 20). Each spacer 208 is adjustably mounted on a respective wall panel 160 by spacer-to-wall panel mechanical fasteners 74*i* received in slotted receivers 209. Jamb/head sealing strips 218 are mounted on the jamb/head spacers 208 by spacer-to-sealing strip mechanical fasteners 74*j*.

The head frame subassembly 192 includes an electrical line inlet 214 aligned with a respective notch 216 in a respective transom panel 187. Each door frame 186 hingedly receives a respective door 220 for selectively closing the door opening 185. The door opening 185 is shown centered in a respective shell end wall 154, but could be located off-center to align with a respective existing door opening 10.

Insulation means 222, for example, expanded polyurethane foam, is injected through respective foam inlet or injection ports 184*a*, 184*b*, 184*c* into interstitial spaces 224 between the existing building 4 and the shell system 34. The insulation foam 222 serves to insulate the interior of the existing building 4 and can provide a measure of protection for it against further deterioration from rust, corrosion and the like. Still further, the insulation foam 222 can bond the existing walls 6, 8 and the existing roof 12 to the shell system 34 whereby the resulting, encapsulated building can achieve greater strength and structural rigidity than would be achieved if the existing building 4 and the shell system 34 were not connected in this manner.

IV. Encapsulating Method and Operation of the Structure 2

The structure 2 can be sized to fit relatively standard (e.g., 6' wide×8' long) existing buildings. By providing slotted receivers at many of the connections, relatively fine adjustments can be made in the configuration and dimensions of the underpinning system and the shell system to accommodate slight variations in the configurations and dimensions of existing buildings to be encapsulated. The encapsulating structure 10 could be custom fabricated to accommodate particular existing buildings. Furthermore, certain components are usable with various sizes and configurations of existing buildings. Economy in construction is accomplished by providing a certain degree of modularity for the components of the encapsulating structure 2.

Installation in situ can begin by mounting the side rails 38. The receivers 17 can be cut in the existing channel members 14 with a cutting torch as shown in FIG. 6, or the existing channel members 14 can be drilled to provide the necessary receivers 17 for alignment with the inner mounting member flange receiver 62. The side rails 38 are then bolted to the existing channel members 14 by suitable mechanical fasteners 74*k*.

The floor joists 102 receive the resilient strips 106 placed thereon and are raised into place between the existing floor structure flanges 22 by a pair of cables 107 which extend between the end rails 40 and are tightened by cable retraction devices 108. With the floor joists 102 in place, the floor support beams 92 are then lifted into supporting engagement thereunder and bolted at their ends 98 to respective pairs of beam brackets 82. The cables 107 and the cable retraction devices 108 can then be removed.

The outrigger legs 20 can then be mounted on the side rails 38 with the mechanical fasteners 74*c* extending through the outrigger legs 20 and respective mounting channels 116. The outrigger base plates 126 preferably engage a ground surface 30 below the structure 2, and can be extended into excavations in the ground if necessary to reach soil with a sufficient bearing capacity or to reach soil located below the frost line. With the side rails 38 mounted on the existing channel members 14, the end rails 40 can be installed by placing the couplers 58 in respective end rail ends 70 and securing them in place with the mechanical fasteners 74*a*. The slotted receivers 72 in the end rail ends 70 permit adjustments to the overall width of the perimeter frame assembly 36 to accommodate different spacings of the existing channel members 14.

The scissor jack assemblies 114 may or may not be required, depending upon the condition of the existing building 4, the clear span of the end rails 40, etc. The scissor jack assemblies 114 are installed by placing mechanical fasteners 74*d* in corresponding, aligned receivers 86, 90 with the base plate 126 engaging the ground surface 30.

With the frame assembly 36 and the foundation subsystem 110 in place (FIG. 3), the shell system 34 can be installed. The shell system 34 includes an open bottom 210 which receives the existing building 4 as the shell system 34 is lowered in place by a suitable crane (not shown) connected by lifting lines 212 connected to the lifting lugs 182. The shell system 34 is connected to the underpinning system 32 by mechanical fasteners 74*e* which connect the lower wall panel flanges 168*b* to the side and end rails 38, 40.

The receivers for the mechanical fasteners 74*e* can be slotted to permit adjustable positioning the wall panels 60 on the side and end rails 38, 40.

The seal, jamb and head sub assemblies 188, 190 and 192 of the door frame 186 are adapted for adjustable mounting with the spacers 194, 208 thereof being adapted to adjustably extend between the door opening 185 and an existing end wall 8. One or both of the end walls 154 can receive door assemblies 158. The transom notch 216 and the electrical line inlet 214 receive the electrical line 24.

Insulating foam 222, which can comprise, for example, polyurethane, is injected into the interstitial space between the existing building 4 and the shell system 34 by means of suitable equipment, which can include a nozzle 230 as shown in FIG. 22. The nozzle 230 is inserted through the foam inlet ports 184*a*, 184*b*, 184*c* in the walls 52, 54 and the roof 56. Alternatively, other types of insulating material could be placed between the existing building 4 and the shell system 34.

The doors 220 are hingedly installed on the door frames 186. Vent caps 226 can be placed on top of the vents 180, which are sized to telescopically receive the existing vents 228 (FIG. 18). It will be appreciated that the various receivers in the structure 2 and in the existing building 4 can be slotted or otherwise enlarged to permit adjustments in the mechanical fastening of the various components. Standard size components for the structure 2 can thus be utilized to accommodate the existing buildings 4 which vary somewhat in size and configuration. The materials for encapsulating structure 2 can be chosen for their suitable characteristics, such as weather resistance (e.g. stainless steel, painted steel or aluminum), strength, availability and cost.

It is to be understood that while certain forms of the present invention have been illustrated and described herein, it is not to be limited to the specific forms or arrangement of parts described and shown.

What is claimed and desired to be secured by Letters Patent is as follows:

1. A structure for encapsulating an existing building, which comprises:

(a) underpinning means comprising a perimeter frame assembly, a floor support beam extending across said perimeter frame assembly, and a plurality of floor joists resting on said floor support beam and extending transversely with respect thereto;

(b) fastening means for fastening the underpinning means to the existing building;

(c) shell means having wail means, a roof connected to the wall means and an open bottom adapted to receive the existing building; and (d) shell mounting means for mounting said shell means on said underpinning means.

2. The structure according to claim 1 wherein said perimeter frame assembly includes:

(a) a pair of frame side rails extending in generally parallel, spaced relation and a pair of frame end rails extending in generally parallel, spaced relation, said frame assembly having a generally rectangular configuration with corners and said side rails and end rails being joined together thereat.

3. The structure according to claim 2 wherein said floor support beam extends between said frame end rails in spaced relation between and generally parallel to said side rails.

4. The structure according to claim 3, which includes:

(a) transverse frame adjustment means for adjusting the spacing between said frame side rails.

5. The structure according to claim 2 wherein said underpinning means includes:

(a) a pair of outrigger assemblies each connected to a respective frame side rail and including ground engaging means for engaging ground below said perimeter frame assembly and for supporting same.

6. The structure according to claim 5 wherein said underpinning system includes:

(a) said pair of outrigger assemblies comprising a first pair of outrigger assemblies; and (b) a second pair of outrigger assemblies each attached to a respective frame side rail.

7. The structure according to claim 2 wherein said underpinning means includes:

(a) an end foundation assembly connected to one of said frame end rails and including ground engaging means for engaging ground below said perimeter frame assembly and for supporting same.

8. The structure according to claim 7 wherein:

(a) said end foundation assembly comprises a pair of scissor jack legs each having an upper end connected to said frame end rail and a lower end connected to said ground engaging means.

9. The structure according to claim 2 wherein said underpinning fastening means includes:

(a) each said frame side rail having a mounting flange; and (b) mounting means for mounting said mounting flanges on said existing building.

10. The structure according to claim 9, wherein:

(a) said existing building includes a pair of existing floor support members; whereby (b) each said frame side rail flange of the structure is adapted for mounting on a respective existing floor support member; and whereby (e) said mounting means of the structure is adapted for mounting said frame side rails on said existing floor support members.

11. The structure according to claim 1 wherein said shell means includes a door opening in said wall means and a door frame at least partly surrounding same.

12. The structure according to claim 11 wherein said door frame includes:

(a) adjustable spacer means for connection to said existing building.

13. A structure for encapsulating an existing building having an existing floor support member, an existing floor structure on said existing floor support member, existing side walls, existing end walls, a door opening in one of the end walls and an existing roof mounted on the existing walls, which structure comprises:

(a) an underpinning system including a rail and floor support means connected to said rail and adapted to engage the existing floor structure for supporting same;

(b) rail-to-floor support member mounting means adapted for mounting said rail on said existing floor support member;

(c) a shell system including:

(1) a pair of side walls;

(2) a pair of end walls each connected to and extending between said side walls;

(3) a roof mounted on said wails;

(4) an open bottom adapted to receive said existing building;

(5) shell system to underpinning system mounting means for mounting said shell system on said underpinning system; and (6) a door assembly in one of said end walls for communicating with the existing door opening; and (d) a foundation subsystem comprising a plurality of outrigger assemblies each having a vertical outrigger leg being vertically adjustably mounted to said underpinning system for supporting said structure.

14. The structure according to claim 13 wherein said underpinning system includes:

(a) a pair of side rails each having opposite ends;

(b) a pair of end rails each having opposite ends;

(c) a perimeter frame assembly having a generally rectangular configuration formed by said rails with four corners; and (e) each said end rail being connected at its opposite ends to respective side rail ends at respective perimeter frame assembly corners.

15. The structure according to claim 14, which includes:

(a) transverse frame assembly adjustment means for adjusting the spacing between said side rails.

16. The structure according to claim 15, which includes:

(a) a pair of couplers extending at substantially right angles from one of said side rail ends and said end rail ends, said couplers being connected to the ends of the other of said side rails and end rails.

17. The structure according to claim 16, wherein each said coupler is slidably adjustable mounted on a respective rail end.

18. The structure according to claim 17, which includes:

(a) a fastening system for fastening said couplers to said rail ends, said fastening system including slotted receivers and mechanical fasteners extending through said slotted receivers.

19. The structure according to claim 17 wherein:

(a) each said coupler is telescopically received in a respective rail end.

20. The structure according to claim 19 wherein:

(a) each said coupler has the general cross-sectional configuration of a channel; and (b) each said rail end receiving a respective coupler has a portion with the general cross-sectional configuration of a channel.

21. The structure according to claim 13 wherein said existing floor support member includes a receiver and wherein said rail-to-floor support member mounting means comprises:

(a) said rail including a flange having a receiver; and (b) a mechanical fastener extending through said flange and adapted to extend through said floor support member receivers.

22. The structure according to claim 14 wherein said floor support means includes:

(a) a pair of floor support beams each having opposite ends connected to said end rails and extending in parallel, spaced relation to said side rails between said end rails; and (b) a plurality of floor joists located on and supported by said floor support beams, said floor joists being adapted for connection to said existing floor structure.

23. The structure according to claim 22, which includes:

(a) a plurality of resilient strips each placed on top of a respective floor joist and being adapted for engagement with the existing floor structure.

24. The structure according to claim 22 which includes:

(a) two pairs of floor support beam mounting brackets mounted on each said end rail and connected to respective floor support beam ends.

25. The structure according to claim 24, which includes:

(a) vertically adjustable connection means for connecting said floor support beam ends to said bracket pairs.

26. The structure according to claim 25 wherein:

(a) said vertically adjustable connection means comprises mechanical fasteners and slotted receivers.

27. The structure according to claim 22 wherein each said floor support beam comprises a box beam.

28. The structure according to claim 14, wherein:

said outrigger assemblies are each vertically adjustably mounted on a respective side rail.

29. The structure according to claim 28 wherein each said outrigger assembly includes:

(a) a mounting channel affixed to a respective side rail for vertically slidably receiving said respective outrigger leg, each said leg having an upper and lower end;

(b) a gusset in said side rail in proximity to said mounting channel;

(c) an outrigger base plate mounted on said outrigger leg lower end; and (d) a mechanical fastener extending through said mounting channel and said leg.

30. The structure according to claim 14, which includes:

(a) a pair of scissor jack assemblies each mounted on a respective end rail and being adapted for engagement with the ground surface below said existing building.

31. The structure according to claim 30 wherein each said scissor jack assembly includes:

(a) a pair of scissor jack legs each having upper and lower ends;

(b) each said scissor jack leg being pivotally connected at its upper end to a respective end rail; and (c) a scissor jack base connected to said scissor jack leg lower ends and including a base plate adapted for engaging the ground surface.

32. The structure according to claim 31 wherein:

(a) each said end rail includes an angle-section stiffener with multiple receivers and an outer flange with multiple receivers aligned with respective stiffener receivers; and (b) a pair of mechanical fasteners each extending through respective aligned pairs of stiffener and outer flange receivers and a respective scissor jack leg upper end.

33. The structure according to claim 14, which includes:

(a) each said side and end wall of said shell having a wall panel with a lower flange mounted on a respective rail.

34. The structure according to claim 33, which includes:

(a) wall panel-to-rail adjustable mounting means including a slotted receiver and a mechanical fastener extending therethrough for slidably, adjustably mounting each said wall panel flange on a respective rail.

35. The invention on claim 13 wherein said door assembly includes:

(a) a door opening in said one end wall;

(b) a door frame having seal, jamb and head subassemblies mounted on said one end wall in said door opening; and (c) a door hingedly mounted on said door frame and movable between open and closed positions with respect to said door opening.

36. The structure according to claim 35 wherein each said door frame subassembly includes:

(a) a spacer adapted for connection to said existing building and adjustable door frame subassembly mounting means adapted for adjustably connecting said existing building with said one end wall.

37. In combination with an existing building including an existing floor structure, existing side walls, existing end walls, an existing roof, an existing door opening in one of the end walls, an electrical line extending to one of the end walls, and a pair of floor support members each located in proximity to a respective side wall and below the existing floor structure, the improvement of an encapsulating structure, which structure comprises:

(a) an underpinning system, which includes:

(1) a pair of side rails each having a mounting flange;

(2) a plurality of mechanical fasteners fastening each said side rail mounting flange to a respective existing floor support member;

(3) each said side rail-having opposite ends and a pair of couplers each extending at a substantially right angle from a respective side rail end;

(4) a pair of end rails each including opposite ends and two pairs of floor support beam mounting brackets, each pair being located in spaced relation to a respective end rail end;

(5) each said end rail end telescopically and adjustably receiving a respective coupler;

(6) a pair of floor support beams each having the cross-sectional configuration of a box beam and including opposite ends each vertically adjustably mounted on a respective pair of beam mounting brackets;

(7) a plurality of floor joists each positioned on top of said floor support beams and extending transversely with respect thereto in engagement with said existing floor structure;

(8) two pairs of outrigger assemblies, each pair being mounted on a respective side raft and each outrigger assembly including a mounting channel mounted on the side rail, an outrigger leg with upper and lower ends vertically adjustably received in and affixed to the mounting channel and including upper and lower ends, and an outrigger base plate mounted on the outrigger leg lower end;

(9) a pair of scissor jack assemblies each mounted on a respective end rail and including a pair of scissor jack assembly legs with upper ends horizontally adjustably mounted on the end rail, lower ends, a base channel pivotally mounting the scissor jack leg lower ends and a base plate mounted on the base channel; and

(10) said side rails and said end rail being connected at their ends to form a generally rectangular perimeter frame assembly with four corners including adjustment means for adjusting the transverse spacing of the side rails; and (b) a shell system, which includes:

(1) opposite side walls;

(2) opposite end walls;

(3) each said wall comprising a plurality of wall panels each including a lower wall panel flange mounted on the perimeter frame assembly and upper and lower foam inlet ports;

(4) a door opening in one of said end walls;

(5) a roof, which includes a roof skin, a ridge line, a plurality of rafters extending outwardly and downwardly from the ridge line, a plurality of purlins extending between respective adjacent pairs of rafters, a plurality of roof foam inlet ports, in said roof skin, a plurality of vents in said roof skin along the ridge line thereof, and a pair of lifting lugs located in spaced relation along said ridge line;

(6) an interstitial space between said existing side walls, end wall and roof and said encapsulating structure side walls, end wall and roof respectively;

(7) form insulating material in said interstitial space;

(8) said end wall door opening being generally aligned with said existing door opening;

(9) a transom in said one end wall including a notch communicating with said door opening;

(10) a door frame assembly including: a sill subassembly having an angle-section spacer engaging said existing floor structure and adjustably mounted on a respective end rail, an angle-section transition member mounted on said spacer and said end rail and a threshold mounted on said transition member; a pair of jamb subassemblies each including a spacer engaging a respective existing end wall and adjustably mounted on a respective wall panel, and a sealing strip mounted on the wall panel adjacent to the door opening; and a head subassembly including a head spacer engaging the existing end wall and adjustably mounted on the transom, and a head sealing strip including an electrical line notch aligned with said transom panel notch and receiving said electrical line; and

(11) a door hingedly mounted on one of said jamb subassemblies and movable in said door opening between open and closed positions.

* * * * *